US005875830A

United States Patent [19]

Singer et al.

[11] Patent Number: 5,875,830

[45] Date of Patent: Mar. 2, 1999

[54] METALLIC ARTICLES HAVING HEAT TRANSFER CHANNELS AND METHOD OF MAKING

[75] Inventors: Alfred Richard Eric Singer, Swansea; Richard Michael Jordan, Hook Norton; Allen Dennis Roche, Aberdare, all of United Kingdom

[73] Assignee: Sprayforming Developments Limited, Swansea, United Kingdom

[21] Appl. No.: 676,104

[22] PCT Filed: Jan. 20, 1995

[86] PCT No.: PCT/GB95/00126

§ 371 Date: Jul. 8, 1996

§ 102(e) Date: Jul. 8, 1996

[87] PCT Pub. No.: WO95/19859

PCT Pub. Date: Jul. 27, 1995

[30] Foreign Application Priority Data

Jan. 21, 1994 [GB] United Kingdom ..... 9401117
Apr. 19, 1994 [GB] United Kingdom ..... 9407691

[51] Int. Cl.[6] ..... B22D 19/00; B22D 23/00

[52] U.S. Cl. ..... 164/19; 164/46; 164/98; 164/132; 428/553; 428/554; 428/614; 428/937

[58] Field of Search ..... 164/6, 19, 46, 164/132, 98, 108; 427/422; 428/548, 552, 553, 554, 614, 937

[56] References Cited

U.S. PATENT DOCUMENTS 2,944,338 7/1960 Craig ..... 428/937 X
3,638,299 2/1972 Garner et al. ..... 164/6 X
4,549,597 10/1985 Hamamura ..... 164/46 X
4,574,451 3/1986 Smashey et al. ..... 164/46 X

FOREIGN PATENT DOCUMENTS 51-99622 9/1976 Japan ..... 164/132
55-28780 7/1980 Japan ..... 164/132
455798 2/1975 U.S.S.R. ..... 164/132

OTHER PUBLICATIONS

Abstract of Japanese Patent Publication 59–27765 Published Feb. 14, 1984.

*Primary Examiner*—J. Reed Batten, Jr.
*Attorney, Agent, or Firm*—David P. Gordon; David S. Jacobson; Thomas A. Gallagher

[57] ABSTRACT

Metallic articles having heat transfer channels are produced by solidification of molten metallic material about preformed channel defining members such that a solidified metallic deposit having heat transfer channels is formed. The channel defining members may be in the form of either solid elements (which are subsequently removed to leave the channels), or conduit elements (which may remain permanently embedded in the article). Moulds, dies, cores and other tools for use in moulding or casting of plastics and metals are particularly suitably formed by the process, the heat transfer channels being used for cooling of the respective articles during use. The molten metallic material is preferably deposited by spray forming utilizing one or more sprays of molten metallic material.

14 Claims, 1 Drawing Sheet

METALLIC ARTICLES HAVING HEAT TRANSFER CHANNELS AND METHOD OF MAKING

BACKGROUND OF THE INVENTION

1. Field of the Invention

This invention relates to the production of at least partially metallic articles, and in particular to the production of such articles with defined heat transfer channels.

2. State of the Art

Articles such as dies, moulds and other tools are typically required to operate within a specific temperature range in order to ensure that the operation for which they were designed proceeds smoothly and produces an optimised product. Examples of this are plastic injection moulding (PIM) techniques where it may be desirable to hold the dies at a temperature of, for example, 100° C. As a further example, in the case of high pressure die casting (HPDC) techniques using aluminium alloys, a preferred temperature range may be 200°–250° C.

In both examples the injected material is at a higher temperature than the mould or die. The mould or die cools the injected material until it becomes substantially solid after which the product is ejected. In the process of cooling the injected material the mould or die becomes relatively hotter and must then be allowed to cool (or be artificially cooled) to return to the required operational temperature range.

To reduce cycle times, and therefore increase production efficiency, it is preferable to cool mould or dies during or after use by means of in-built heat transfer channels for cooling water to circulate within the mould or die. Typically, cooling channels such as these are made by drilling into the mould or die block during manufacture and fitting connections for the circulation of cooling water or, in some cases, cooling air. The construction of such cooling channels involves complex, accurate and expensive drilling and plugging of many channels.

In other embodiments it is envisaged that it may be desirable to transfer heat to the article, in which case heating fluid may be passed through the heat transfer channels.

SUMMARY OF THE INVENTION

An improved process for the production of metallic articles having heat transfer channels has now been devised.

According to a first aspect, the present invention provides a process for producing an at least partially metallic article, the process comprising solidification of molten metallic material about pre-formed heat transfer channel defining means to form a solidified metallic deposit provided with heat transfer channel means.

The heat transfer channel means may comprise one or more cavities, ducts, voids, or the like of a variety of shapes or configurations. In certain embodiments, channel means of geometric shape, such as substantially circular, triangular or rectangular cross section is preferred.

An article produced in accordance with the first aspect of the invention is characterised by heat transfer channel defining means of a first microscopic structure being embedded in a solidified metallic deposit of a second microscopic structure. It is believed that an article so characterised is novel and inventive per se and accordingly comprises a second aspect of the invention.

The process is particularly suitable for forming articles for use in moulding or casting. In particular, the process may be used in the manufacture of moulds, dies, cores and other tools for use in moulding or casting of plastics or metallic products, such as for example high pressure die casting (HPDC) using aluminium alloys, or plastics injection moulding (PIM). Preferably the heat transfer channel means comprises cooling channel means through which a coolant fluid may pass.

Desirably, the heat transfer channel defining means is metallic and preferably follows a heat transfer path through the deposit between an inlet and an outlet. Typically for moulds and dies the heat transfer path (and therefore pre-formed channel defining means) comprises substantially parallel lengths arranged to carry heat transfer fluid in opposed directions. Preferably, the heat transfer path defined is serpentine.

In a first embodiment, it is preferred that the pre-formed channel defining means comprises at least one pre-formed conduit arranged to become partially or completely embedded within the metallic deposit on solidification thereof. The pre-formed conduit preferably comprises a tube of relatively highly thermally conductive metallic material (compared to material comprising the deposit) such as copper, an alloy thereof, or the like.

In an alternative embodiment, the pre-formed channel defining means comprises one or more channel defining elements about which molten metal is solidified, the element (s) subsequently being removed from the article (preferably in molten form) to leave heat transfer channel means defined in the article.

In this embodiment, the channel defining element(s) may either comprise hollow conduit or tube, or substantially solid material such as, for example, rod or bar. The heat transfer channel defining element (or elements) comprises material of lower melting point than the surrounding solidified deposit, and will typically be metallic in composition. Alternatively a precast inorganic compound such as a salt or mixture of salts may be used preferably in conjunction with, or comprising metallic powder to provide enhanced thermal conductivity.

The article is subsequently heated to a temperature at or above the melting point of the material comprising the channel defining means to effect melting thereof.

In this embodiment, the article comprising the second aspect of the invention is a transient or intermediate product, the channel defining means of the first microscopic structure being subsequently melted out to produce the heat transfer channel means.

It is preferred that one or more sprays of molten metallic material are directed towards the pre-formed channel defining means to form the solidified metallic deposit. The use of so-called spray forming metallurgical techniques particularly as used in the production of moulds or dies is described in prior art publications such as, for example, WO-A-92/02157.

Spray forming techniques are particularly suited to the production of articles in accordance with the invention, and in particular to the embodiment of the invention in which the channel defining elements are subsequently removed from the article in molten form. This is because, when using spray forming techniques (particularly when scanning the spray of molten metallic material) the relatively lower melting point channel defining elements surprisingly remain solid whilst the relatively higher temperature molten material is deposited thereabout.

This facility can be further improved by means of either coating the relatively low melting point channel defining elements with a flux before embedding in the molten metallic material or by using low melting point channel elements comprising a flux. This causes wetting of the embedding higher melting point metallic material on subsequent melting of the lower melting point material following the embedding process, which ensures the formation of smooth heat transfer channels when the channel defining elements are melted out.

In some instances, towards the end of deposition of the molten material to form the article, sufficient heat will remain in the article to cause its overall temperature to rise sufficiently for the lower melting point channel defining means to melt of its own accord without the requirement for a further heating stage.

Desirably, the article comprises layers of spray deposited material, the layers having differing material composition. The layers of differing composition may be produced by respective sprays of differing composition (one or more of which may be of non-metallic composition) . Desirably at least one layer is formed by means of coincident deposition from two or more sprays of differing composition. The deposition of this layer may be controlled such that a layer of graded composition is formed having differing proportions of material from the respective sprays across the thickness of the deposited layer.

This enables a layer of relatively high thermal conductivity material (e.g. copper or copper alloy) to be deposited around the heat transfer channel means, and a layer of harder and typically relatively lower thermally conductive material, such as die or tool steel to be deposited adjacent the working face of the material. Furthermore a third layer, of graded composition, may be provided intermediate the aforementioned two layers to provide a graded transition from the highly thermally conductive layer to the layer of harder material.

Desirably, the portion of the deposit embedding the heat transfer channel means is built up by directing a spray of molten metallic material toward the heat transfer channel defining means, and moving the deposit on manipulator means within the spray in a predetermined manner.

Preferably, the sprayed material of the deposit is provided to a predetermined level at which level the channel defining means is introduced to be embedded within subsequent deposited material comprising the deposit.

Alternatively, although less preferred, the channel defining means may be held in position at the predetermined level prior to the deposit having been built up to the predetermined level.

The invention will now be further described in specific embodiments by way of example only, and with reference to the accompanying drawings:

DETAILED DESCRIPTION OF THE PREFERRED EMBODIMENT

Figure 1:
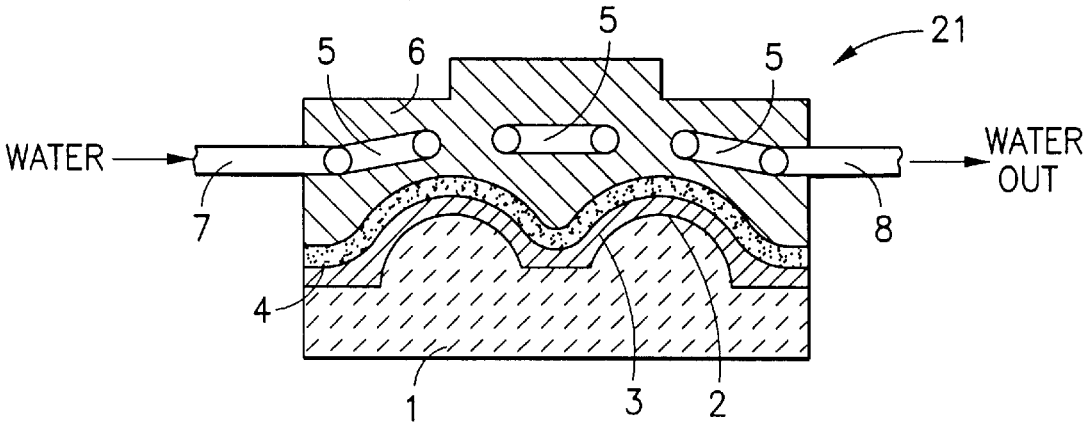
FIG. 1 is a schematic sectional view through a die for use in high pressure die casting, which die is produced as an article according to the process of the invention.

Referring to the drawings, and initially to FIG. 1 in particular, there is shown a die (21), produced in accordance with the invention after subsequent machining and grinding to fit a bolster. A refractory ceramic pattern (1) is mounted on a manipulator (not shown) and moved rapidly beneath a first arc spray gun (not shown) fed with 0.8 carbon die steel wires in a spray chamber using nitrogen as the atomising gas. The manipulator is programmed to produce an initial deposited layer of die steel which provides a working die face which is replicated from the pattern (1). A uniform die steel deposit (3) 10 mm thickness over the whole of the top face of the pattern is then built up by deposition from the first arc spray gun. A second arc spray gun (not shown) is then brought into operation spraying copper while the manipulator is moving. The current and therefore the rate of feeding, spraying and deposition of the die steel wire is gradually decreased over the next 0.5 minute during which time the spraying copper is gradually increased thus producing a layer of graded composition (4) 3 mm in thickness (i.e. the proportion of copper to die steel varies in a predetermined, graded manner across layer 4). Spraying of copper is continued for a further period to deposit a layer of copper approximately 3 mm in thickness with the programming of the manipulator adapted to produce a flatter profile.

Spraying of copper is halted briefly allowing time for pre-formed cooling tubes (5) consisting of a serpentine array of 3 mm internal diameter copper tubes to be quickly clamped to the copper deposit and while still hot the spraying of copper is continued with the manipulator programmed to give a minimum of shadowing by the tubes (5) and a reasonably flat top surface to the top portion of the die (6). Finally, the top and sides were machined or ground to a shape suitable for attaching to a bolster and connections were made at positions (7) and (8) for incoming and outgoing connection to a cooling water circuit.

As an alternative to spraying copper, the second arc spray gun can be used to spray low carbon steel, such that the cooling tubes (5) are incorporated in a low carbon steel deposit. This procedure is slightly simpler and less expensive than the first but does not give such a rapid rate of operation of the dies in a PIM or HPDC machine because of the lower thermal conductivity of the backing low carbon steel relative to copper.

A further alternative is to produce the die and backing entirely of die steel (i.e. from a single spray) with the metallic cooling tubes (5) being embedded in tool steel. This is not a preferred procedure because of high cost of die steel and its relatively low thermal conductivity.

In certain circumstances all the three alternative procedures described above can be carried out without interruption by clamping the cooling tubes (5) in their appropriate position in relation to the pattern before the commencement of spraying. This is not recommended for more complex designs of die and careful control of manipulation is required because deposits of low conductivity hard die steel will occur on the cooling tubes (5) and shadowing may be a problem with the deposition of the hard die steel facing metal. The problem of shadowing is well known in spray forming production techniques, and ameliorated in the present technique by controlling the manipulator to move the article rapidly in different directions in the spray.

A further alternative process is to bond cooling tubes to conventionally produced dies using spray deposition. A suitable procedure is to roughen the back of a conventionally produced die and preferably to machine grooves, undercutting if necessary. Metal cooling tubes can be fixed in an appropriate position above the back surface of the die, both being held in position in a manipulator. A higher conductivity metal such as copper or aluminium bronze can then be sprayed on to the assembly of dies and cooling tubes so that the cooling tubes are embedded in the spray deposit. This procedure is often satisfactory but it does not have the advantages of very strong adhesion to the working face of the die given by graded compositions. The adhesion may be improved to some extent by using a proprietary sprayed bond coat between the conventional die and the higher conductivity material surrounding the cooling tubes. A typical proprietary bond coat consists of a thin layer of an aluminium bronze.

In certain instances it may be advantageous to consolidate the spray deposit at the same time as it is deposited by the process of simultaneous spray peening (SSP). This has the advantage of enabling the internal stresses in the deposit to be controlled in order to avoid distortion of the die and to achieve higher density in the deposited material. A suitable spray peening process is described in GB-A-1605035.

It is generally advantageous to have the cooling tubes completely embedded in the higher thermal conductivity backing material in order to obtain the maximum cooling effect. In certain cases however, it may be more convenient or economical to have the cooling tubes only partly embedded in the metallic higher conductivity backing in which case it is usual to complete the die block by casting on to the backing material with partly embedded tubes a plasticised cement or other material that is cheap, easily machined to a shape required to fit the bolster yet having an adequate compressive strength.

As an alternative to using hollow metallic cooling tubes (5), substantially solid rods can be used to define the location and geometry of the cooling channels. The rods are of lower melting point composition than the material sprayed to form the deposit, preferably comprising lead rich solder rods (although other compositions such as tin/zinc or aluminium based alloys may be used).

The solid rods may be embedded in the spray deposited material using the techniques as described herein for embedding hollow tubes (5). Surprisingly it has been found that, presumably due to scanning of the sprays of molten material when forming the deposit, the solid rods do not themselves melt whilst being embedded in the deposited molten material.

Towards the end of spray deposition, the die block (21) becomes heated to such an extent that its temperature rises above the melting point of the rods. The molten metal of the rods is then centrifuged out by rotation of the manipulator on which the die block is formed leaving a continuous cavity or channel arrangement for cooling purposes internally of the block.

A particularly beneficial effect of utilising relatively low melting point rods is that if some shadowing occurs it will merely add to the depth and size of the cooling channels without in any way damaging the cooling benefit. In this respect it is to be preferred to the use of, for example, an embedded copper tube.

In practice, it is beneficial to choose a low melting point metal for the rods that does not distort or collapse during the subsequent spray deposition process. Thus a solder rich in lead, with a small addition of copper and the remainder tin, is to be preferred to a eutectic tin-lead composition having a lower melting point. Some zinc alloys can also be used in the same way.

The shape of the rod can be chosen to give the maximum cooling nearest the die face, in which case the bar can be of square section or a section having a wider flat surface near to the die face. In all cases, it is advantageous to use rods that are malleable so that they can be bent into a suitable configuration before embedding.

Figure 2:
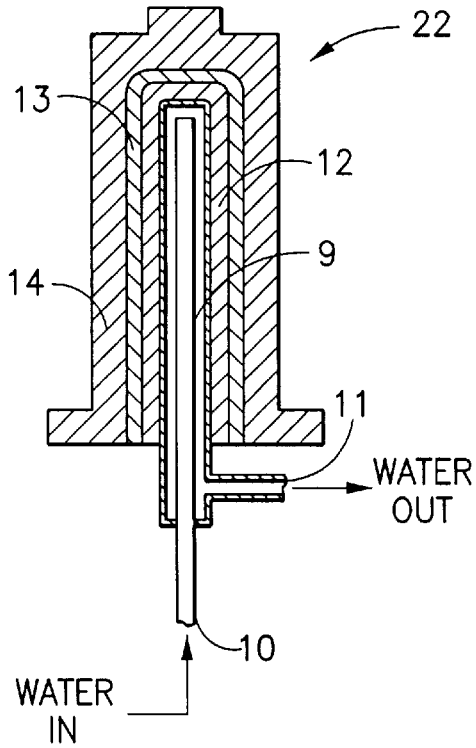
FIG. 2 is a schematic sectional view through a mould core produced as an article according to the process of the invention.

Referring now to FIG. 2, a similar technique is used for production of cores (22) for insertion into dies using the process of the invention. It is often important to cool cores during the use of dies with core inserts, because cores, by their very nature, are often surrounded by the hot thermoplastic or metal during PIM or HPDC. Cores are generally of male form and therefore preferably provided with internal water or air cooling.

The cooling system comprises an arrangement (9) of two concentric copper tubes one inside the other with a water inlet (10) and outlet (11). The tube assembly (9) is mounted on a manipulator (not shown) which rotates on the axis of the cooling tubes and also has a longitudinal motion in the direction of the axis. A layer of copper (12) is deposited from an arc spray gun (not shown) on the cooling tube assembly to cover the assembly to a depth of 2 mm. The composition is then graded as described in the first example but in this case the deposition of copper is gradually decreased while that of tool steel is increased to finally give an external shell of tool steel. The graded composition is shown at (13) merging into the tool steel shell at (14).

Because the procedure for producing cores is reversed when compared with the production of dies or moulds, the external form of the core is only roughly the shape required. The sprayed external form therefore must be slightly larger than the precise shape required which is obtained by subsequent grinding and machining.

As for moulds or dies, substantially solid rods can be used to replace preformed tubes for defining cooling channels in cores.

In such cases it is generally more convenient to start with a suitable array of rods of a low melting point metal and then spray on to the array a high conductivity metal which is subsequently graded into the hard die material as described above for the embedding of tubes 9 in core 22. Finally, the rods must be melted out.

Dies, moulds, tools and cores made by the process of the invention can beneficially be used for a wide range of compressing, compacting, pressing and drawing operations in addition to PIM and HPDC where temperature control of the die or mould is important.

We claim:

1. A process for producing an at least partially metallic article provided with heat transfer channel means, said process comprising spray depositing molten metallic material to form a solidified metallic deposit about pre-formed heat transfer channel defining means, wherein said pre-formed channel defining means comprises material having a melting point lower than the melting point of said spray deposited metallic material.

2. A process according to claim 1, wherein said heat transfer channel defining means is melted to leave said heat transfer channel means defining in the spray deposited metallic material.

3. A process according to claim 2, wherein said pre-formed channel defining means is melted by subsequently elevating the temperature of said spray deposited metallic material which forms the article, thereby to effect melting of said channel defining means.

4. A process according to claim 1, wherein said pre-formed channel defining means comprises at least one substantially solid channel defining element.

5. A process according to claim 1, wherein said pre-formed channel defining means comprises a pre-formed conduit.

6. A process according to claim 1, wherein at least the surface of said pre-formed channel defining means comprises a flux material.

7. A process according to claim 1, wherein at least two sprays of differing material composition are used to produce said sprayformed deposit by means of coincident deposition, whereby material is sprayed via a plurality of sprays, said sprays being controlled to produce a gradient of the proportions of the respective materials across the deposit.

8. A process according to claim 7, wherein said sprays are controlled to produce a deposit having a first material composition and properties in the region about said heat transfer channel means, and a second material composition and properties in a region distanced from said heat transfer channel means.

9. A process according to claim 8, wherein said sprays are controlled to produce a sprayformed deposit having relatively high thermal conductivity in a region about the heat transfer channel means and being relatively harder in a region distanced from the heat transfer channel means.

10. A process according to claim 1, wherein said sprayformed deposit is supported on a manipulator means in a spray, the manipulator means being moved within said spray.

11. A process according to claim 1, for producing moulds, dies, cores or other tools, for use in moulding and casting.

12. A process according to claims 11, for producing a mould or die wherein the sprayformed metallic deposit is initially built up on a pattern to produce a die or mould working face, said heat transfer channel defining means subsequently being incorporated in the deposit at a position spaced from the working face of said mould or die.

13. An at least partially metallic article comprising heat transfer channel defining means of a first microscopic structure embedded in a solidified spray deposited metallic material of a second microscopic structure, wherein the heat transfer channel defining means of the first microscopic structure comprises a material having a lower melting point than the melting point of the spray deposited metallic material of the second microscopic structure.

14. An article according to claim 13, being a mould, die, core or other tool for use in moulding or casting.

* * * * *